US010695934B2

(12) United States Patent
Huang

(10) Patent No.: US 10,695,934 B2
(45) Date of Patent: Jun. 30, 2020

(54) CUTTING MECHANISM FOR ROLL FIBER PRODUCT

(71) Applicant: CHAN LI MACHINERY CO., LTD., Taoyuan (TW)

(72) Inventor: Chang-Chou Huang, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 0 days.

(21) Appl. No.: 16/397,153

(22) Filed: Apr. 29, 2019

(65) Prior Publication Data

US 2019/0337179 A1 Nov. 7, 2019

(30) Foreign Application Priority Data

May 7, 2018 (TW) ..... 107115363 A

(51) Int. Cl.

| | |
|---|---|
| ***B26D 7/02*** | (2006.01) |
| ***B26D 7/08*** | (2006.01) |
| ***B26D 7/14*** | (2006.01) |
| ***B26D 1/08*** | (2006.01) |

(52) U.S. Cl.

CPC ..... *B26D 7/14* (2013.01); *B26D 1/085* (2013.01); *B26D 7/02* (2013.01)

(58) Field of Classification Search

CPC ..... B26D 1/085; B26D 2210/11; B26D 3/16; B26D 7/02; B26D 7/08; B26D 7/14

See application file for complete search history.

(56) References Cited

U.S. PATENT DOCUMENTS

| | | | | |
|---|---|---|---|---|
| 6,532,851 | B2 * | 3/2003 | Moss | B26D 7/02 83/457 |
| 7,866,238 | B2 * | 1/2011 | Hsu | B23D 47/04 83/119 |
| 8,950,303 | B2 * | 2/2015 | Tsai | B26D 7/0625 83/112 |
| 2005/0217443 | A1 * | 10/2005 | Matteis | B23D 47/04 83/113 |
| 2012/0204691 | A1 * | 8/2012 | Gambini | B26D 7/02 83/84 |

* cited by examiner

*Primary Examiner* — Stephen Choi

(74) *Attorney, Agent, or Firm* — Rosenberg, Klein & Lee

(57) ABSTRACT

A cutting mechanism for a roll fiber product comprises two clamping devices for clamping the roll fiber product, and a blade for cutting the roll fiber product. The two clamping devices are respectively connected to a push device. During the cutting process, the push devices drive the clamping devices and the roll fiber product thereon swinging so that the two clamping devices break the roll fiber products to reduce the contact area and the friction between the blade and the roll fiber products. In addition, two clamping devices are respectively connected with a push-pull device for increasing the size of the gap therebetween, so as to prevent the blade from touching the cut roll fiber products. Thus, the cutting mechanism of the present invention is able to reduce the wear rate of the blade, and improve the yield rate of the roll fiber products.

10 Claims, 8 Drawing Sheets

CUTTING MECHANISM FOR ROLL FIBER PRODUCT

REFERENCE TO RELATED APPLICATIONS

This non-provisional application claims priority claim under 35 U.S.C. § 119(a) on Taiwan Patent Application No. 107115363 filed May 7, 2018, the entire contents of which are incorporated herein by reference.

FIELD OF THE INVENTION

This invention relates to a cutting mechanism for roll fiber products, which is able to reduce wear rate of blade and improve yield rate of the cut roll fiber product.

BACKGROUND

FIG. 1 is a section view of a conventional cutting mechanism for roll fiber products. The cutting mechanism 10 comprises a first fixed unit 11, a second fixed unit 13 and a blade 15, wherein the first fixed unit 11 is adjacent to the second fixed unit 13 to form a gap 14 therebetween, and the blade 15 is located above the gap 14.

When the roll fiber product 12 is transmitted to a preset position, the first fixed unit 11 and the second fixed unit 13 will hold the roll fiber product 12. Then, the blade 15 is actuated to pass through the gap 14 to cut the roll fiber product 12.

The cutting mechanism 10 is capable of cutting the roll fiber product 12 to form roll fiber products 12 with desired size. However, the cutting section of the roll fiber product 12 may be scorched due to increase of the blade 15 temperature after a period of use. Further, the blade 15 will be worn easily due the friction between the blade 15 and the roll fiber product 12, cause uneven of the cutting section of the roll fiber product 12 and reduction of yield rate of products.

SUMMARY

It is, therefore, the main objective of the present invention to provide a cutting mechanism for roll fiber products. Two clamping devices of the cutting mechanism are respectively connected to a push-pull device. As the blade is actuated to cut the clamped roll fiber products, the push-pull devices will push or pull two clamping devices respectively to increase the size of the gap therebetween and the slit of cut roll fiber products, which reduces the contact area and the friction between the blade and the roll fiber products thus reducing wear rate of blade and improving yield rate of products.

It is another objective of the present invention to provide a cutting mechanism for roll fiber products. The connecting units of two clamping devices are respectively connected to different seats via a shaft, and thus two clamping devices are rotatable on the shafts relative to the seats. Further, the connecting units of two clamping device are respectively connected to corresponding push devices. As the blade is actuated to cut the roll fiber product clamped by the clamping devices, the push devices will push two clamping devices respectively. Thus, the connecting units swing or rotate relative to seats to increase the size of the slit between the cut roll fiber products, and reduce contact area and friction between the blade and the roll fiber products. Thus, reduction of wear rate of the blade and improvement of yield rate of products can be achieved.

For achieving above objects, the present invention provides a cutting mechanism for roll fiber products, comprising: a first clamping device, comprising: a first seat; a first connecting unit connected to said first seat via a first shaft; a first clamping unit connected to said first connecting unit for clamping a roll fiber product; a second clamping device adjacent to said first clamping device, and a gap being formed between said first clamping device and said second clamping device, said second clamping device comprising: a second seat; a second connecting unit connected to said second seat via a second shaft; a second clamping unit connected to said second connecting unit for clamping said roll fiber product; a blade for cutting said roll fiber product located on said gap; a feeding unit for feeding said roll fiber product from said second clamping device to said first clamping device; a push-pull device comprising a first push-pull unit and a second push-pull unit connected to said first seat and said second seat respectively, wherein said first push-pull unit and said second push-pull unit respectively push or pull said first clamping device and said second clamping device moving to adjust a size of said gap between said first clamping device and said second clamping device; and a push device comprising a first push unit and a second push unit respectively connected to said first connecting unit and said second connecting unit, and driving said first connecting unit and said second connecting unit to respectively swing on said first shaft and said second shaft relative to said first seat and said second seat.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
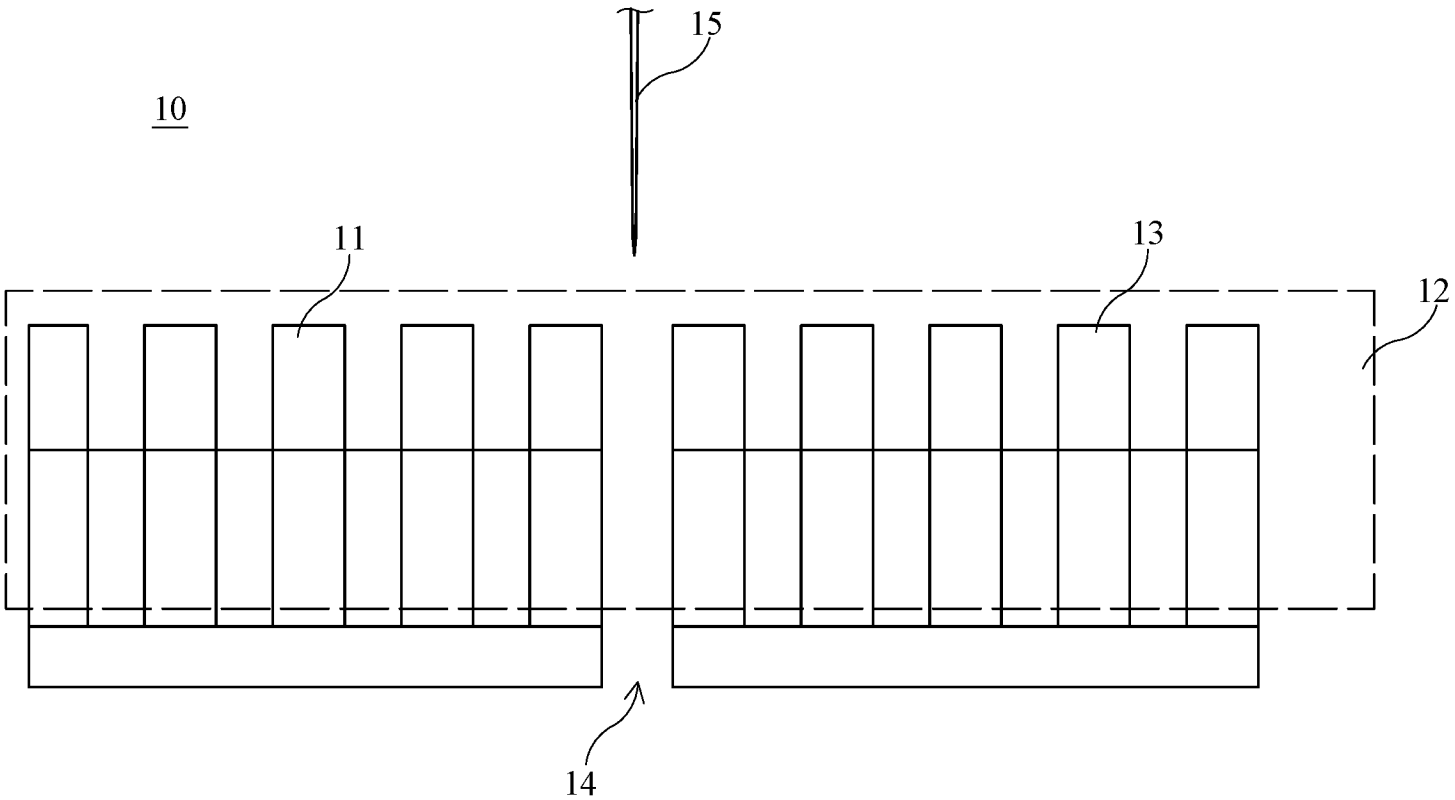
FIG. 1 (PRIOR ART)
FIG. 1 is a section view of a conventional cutting mechanism for roll fiber products.
Figure 2:
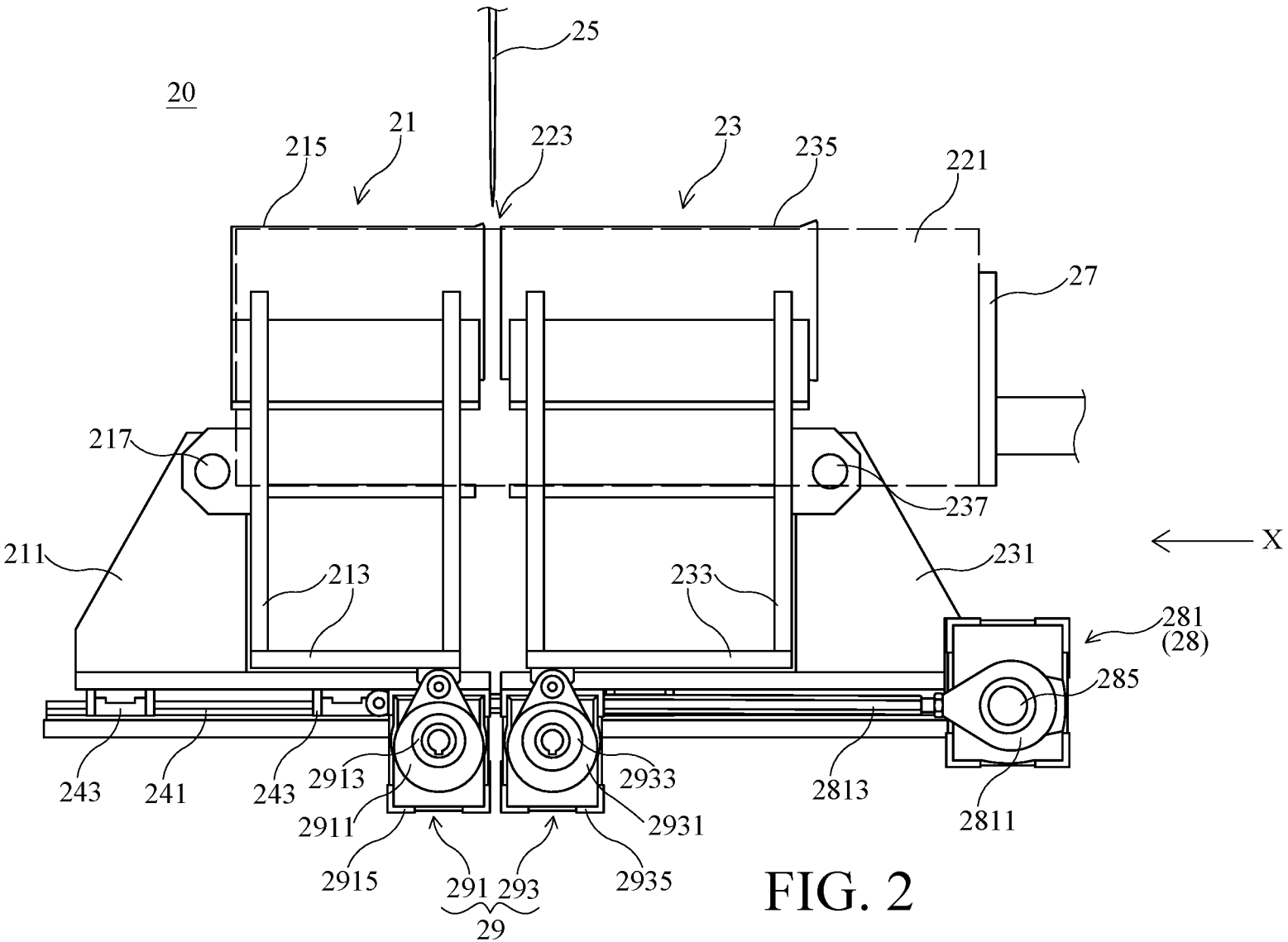
FIG. 2 is a section view of cutting mechanism on a first position according to an embodiment of the invention.
Figure 3:
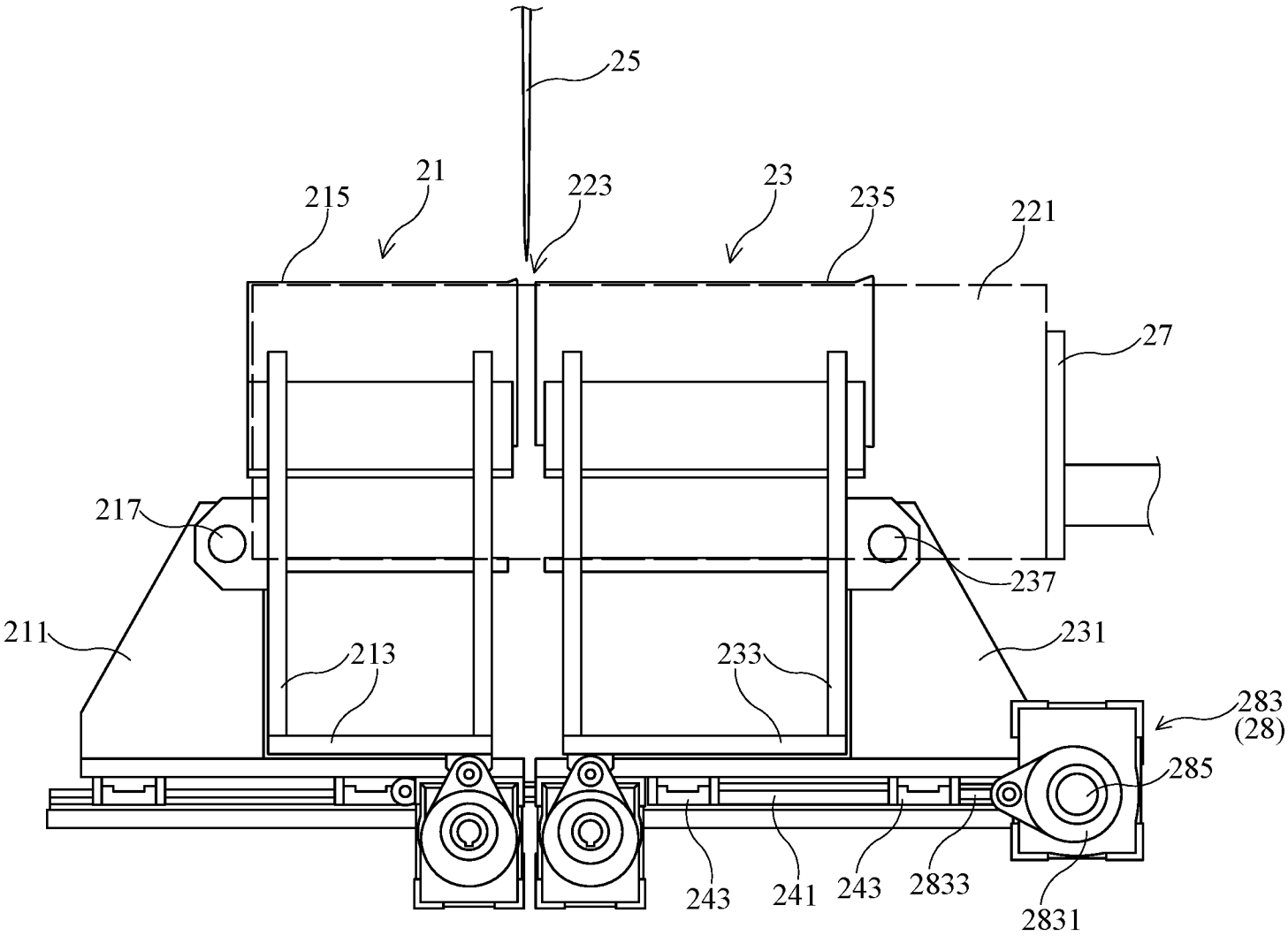
FIG. 3 is a section view of cutting mechanism on a second position according to an embodiment of the invention.

FIG. 2 is a section view of cutting mechanism on a first position according to an embodiment of the invention, and FIG. 3 is a section view of cutting mechanism on a second position according to an embodiment of the invention. The cutting mechanism 20 comprises a first clamping device 21, a second clamping device 23, a blade 25, a feeding unit 27, a push-pull device 28 and a push device 29, wherein the first clamping device 21 and second clamping device 23 are adjacent to form a gap 223 therebetween.

The blade 25 locates above the gap 223 between the first clamping device 21 and the second clamping device 23, and the blade 25 is movable relative to the first clamping device 21 and the second clamping device 23, and enters the gap 223 therebetween to cut roll fiber product 221.

The feeding unit 27 locates upstream of the first clamping device 21 and the second clamping device 23 to push the roll fiber product 221 form the second clamping device 23 toward the first clamping device 21.

The first clamping device 21 comprises a first seat 211, a first connecting unit 213 and a first clamping unit 215, wherein the first clamping unit 215 is connected to the first connecting unit 213, and is movable relative to the first connecting unit 213 to clamp the roll fiber product 221. The first connecting unit 213 is connected to the first seat 211 via a first shaft 217, and is able to swing on the first shaft 217 relative to the first seat 211.

The structure of the second clamping device 23 is similar to the first clamping device 21, and comprises a second seat 231, a second connecting unit 233 and a second clamping unit 235, wherein the second clamping unit 235 is connected to the second connecting unit 233, and is movable relative to the second connecting unit 233 to clamp the roll fiber product 221. The second connecting unit 233 is connected to the second seat 231 via a second shaft 237, and is able to swing on the second shaft 237 relative to the second seat 231.

The push-pull device 28 comprises a first push-pull unit 281 that is connected to the first seat 211, and a second push-pull unit 283 that is connected to the second seat 231. The first push-pull unit 281 and the second push-pull unit 283 are able to drive the displacement of the first seat 211 and the second seat 213 thus to adjust the size of the gap 223 therebetween.

In one embodiment of the invention, the first push-pull unit 281 comprises at least one cam 2811 and at least one connecting rod 2813, as shown in FIG. 2. One end of the connecting rod 2813 is connected to the cam 2811, and the other end of the connecting rod 2183 is connected to the first seat 211. The rotation or swing of the cam 2811 drives the first clamping device 21 moving along the first direction X, such as horizontal direction, via the connecting rod 2813 and the first seat 211.

As shown in FIG. 3, the second push-pull unit 283 also comprises at least one cam 2831 and at least one connecting rod 2833. One end of the connecting rod 2833 is connected to the cam 2831, and the other end of the connecting rod 2833 is connected to the second seat 231. The rotation or swing of the cam 2831 drives the second clamping device 23 moving along the first direction X, such as horizontal direction, via the connecting rod 2833 and the second seat 231.

The cams 2811, 2831 are connected to the same rod 285, and the rotation of the rod 285 drives the cams 2811, 2831 rotating or swinging. Further, swing/rotation phase or swing/rotation angle of the cam 2811 of the first push-pull unit 281 and the cam 2831 of the second push-pull unit 283 may be different to drive the first clamping device 21 and the second clamping device 23 moving to different direction. Specifically, the first push-pull unit 281 pulls the first clamping device 21 back, the second push-pull unit 283 push the second clamping device 23 away to increase the size of the gap 223, and vice versa. Thus, the first clamping device 21 and the second clamping device 23 are able to relatively open or close to change the size of the gap 223 therebetween, and increase the slit between two cut roll fiber products 221.

In one embodiment of the invention, bottoms of the first seat 211 and the second seat 231 are respectively connected to the slide rail 241 via the slide blocks 243. Further, the push-pull devices 28 are respectively connected to the first seat 211 and the second seat 231 via different slide blocks 243 to drive the first seat 211 and the second seat 231 moving along the slide rail 241 on the first direction X.

The push device 29 comprises a first push unit 291 and a second push unit 293. The first push unit 291 is connected to the first connecting unit 213, and drives the first connecting unit 213 rotating or swinging on the first shaft 217 relative to the first seat 211. Further, the second push unit 293 is connected to the second connecting unit 233, and drives the second connecting unit 233 rotating or swinging on the second shaft 237 relative to the second seat 231.

In one embodiment of the invention, the first push unit 291 may comprise a cam 2911 connected to a rod 2913. The rod 2913 is connected to the first seat 211 via a reducer 2915, and the rotation of the rod 2913 drives the cam 2911 rotating or swinging. Further, the cam 2911 connects to the first connecting unit 213. For example, the out surface of the cam 2911 contacts or connects with the first connecting unit 213. The swing or rotation of the cam 2911 pushes the first connecting unit 213 swinging on the first shaft 217 relative to the first seat 211.

The structure of the second push unit 293 is similar to the first push unit 293, and comprises the cam 2931, the rod 2933 and the reducer 2935.

Specifically, one sides of the first connecting unit 213 and the second connecting unit 233 are respectively connected to the first seat 211 and the second seat 231 via the first shaft 217 and the second shaft 237, and the bottom sides of the first connecting unit 213 and the second connecting unit 233 are respectively connected to the first push unit 291 and the second push unit 293. Thus, the first push unit 291 is able to drive the first connecting unit 213 swinging on the first shaft 217, and the second push unit 293 is able to drive the second connecting unit 233 swinging on the second shaft 237 to increase the slit between the cut roll fiber products 221.

It is one embodiment of the invention using the cams 2911, 2931, 2811, 2831 of the push device 29 and the push-pull device 28 to drive the first connecting unit 213, the second connecting unit 233, the first clamping device 21 and the second clamping device 23. In other embodiment, the push device 29 and the push-pull device 28 may drive the first connecting unit 213, the second connecting unit 233, the first clamping device 21 and the second clamping device 23 by cylinders. Thus, the cams 2911, 2931, 2811, 2831 are not limitation of the push device 29 and push-pull device 28.

Figure 4:
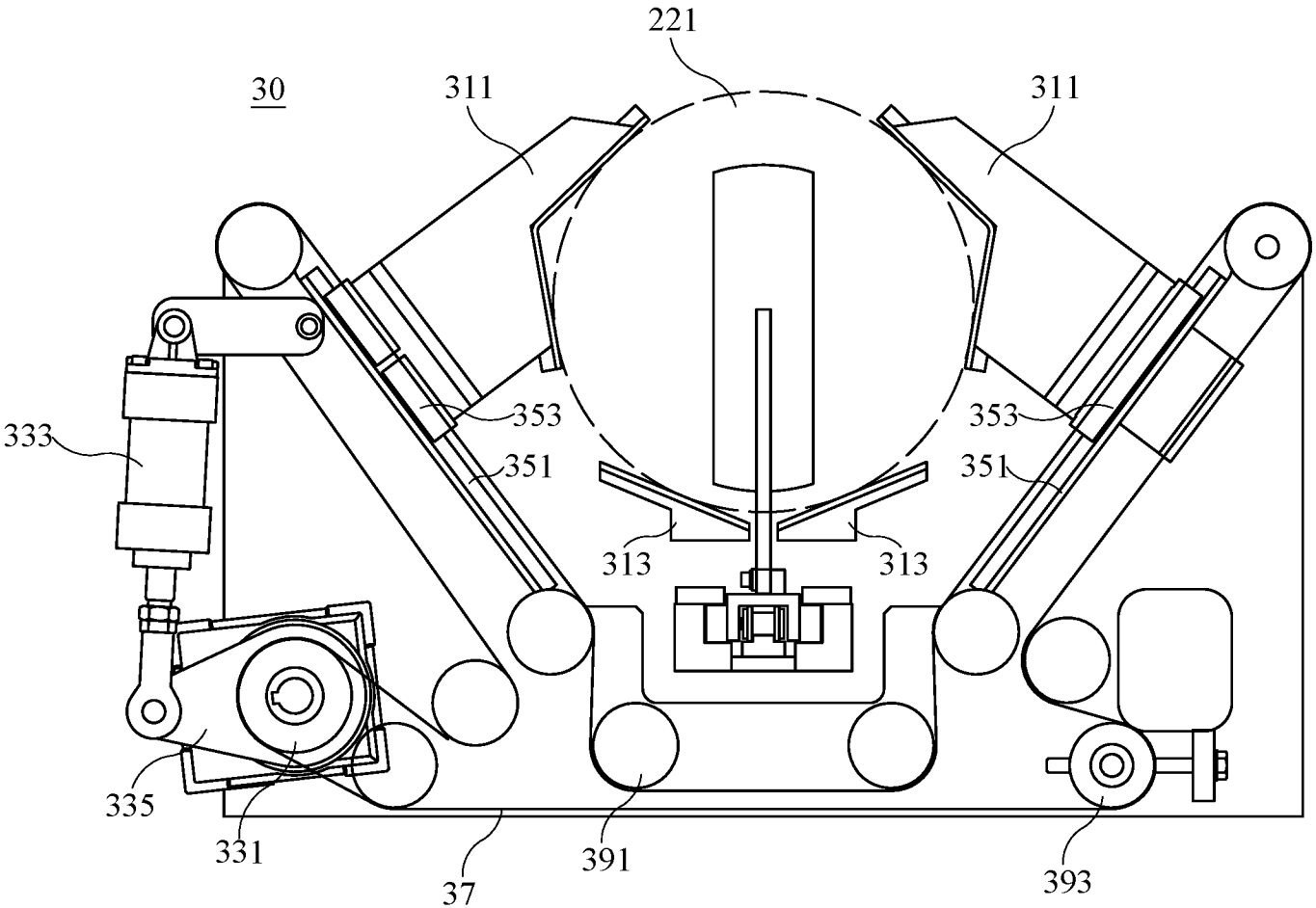
FIG. 4 is a section view of the clamping device of the cutting mechanism according to an embodiment of the invention.

FIG. 4 is a section view of the clamping device of the cutting mechanism according to an embodiment of the invention. The clamping device 30 of the cutting mechanism 20 comprises at least one clamping part 311 and at least one supporting part 313. For example, the clamping device 30 may comprise two clamping parts 311 and two supporting parts 313. The roll fiber product 221 is put on the supporting parts 313, and the clamping parts 311 locate above the roll fiber product 221 and the supporting parts 313. The clamping parts 311 and the supporting parts 313 clamp the roll fiber product 221 therebetween for aiding the blade 25 to cut the roll fiber product 221. Further, the first clamping unit 215 of FIG. 2 and the second clamping unit 235 of FIG. 3 may comprise the clamping part 311 and the supporting part 313.

The clamping device 30 further comprises a servomotor 331, a connecting band 37 and a plurality of wheels 391, wherein the connecting band 37 is installed on the servomotor 331 and the wheels 391. For example, the connecting band 37 may be a roller chain, and the wheels 391 may be sprockets. In one embodiment of the invention, the connecting band 37 is installed on the servomotor 331, the wheels 391 and a tension wheel 393 that can be used to adjust tension of the connecting band 37.

In one embodiment of the invention, the clamping part 311 is disposed on the connecting band 37, and the rotation of the servomotor 331 drives the displacement of the clamping part 311 via the connecting band 37. Specifically, the servomotor 331 can be used to adjust the space between the clamping part 311 and the supporting part 313 for clamping the roll fiber product 221 with different size or circumference. Further, the clamping part 311 and the supporting part 313 are able to clamp or loose the roll fiber product 221 therebetween.

In one embodiment of the invention, a cylinder 333 is connected to the servomotor 331 and/or the connecting band 37. For example, the cylinder 333 is connected to the shaft of the servomotor 331 via a swing arm 335 to help the servomotor 331 to fix the position of the clamping part 311 via the connecting band 37, or drive the displacement of the clamping part 311 via the connecting band 37.

In actual application, the servomotor 331 drives the connecting band 37 to adjust the position of the clamping part 311 firstly thus clamping the roll fiber product 221 between the clamping part 311 and the supporting part 313. However, the power of the servomotor 331 may not enough to drive the clamping part 311 to clamp the roll fiber product 221 stably. Thus, after the servomotor 331 drives the clamping part 311 moving to a preset position, the cylinder 333 will be actuated to help the servomotor 331 to fix the position of the clamping part 311 or drive the displacement of the clamping part 311 thus clamping the roll fiber product 221 between the clamping part 311 and the supporting part 313 stably.

In another embodiment of the invention, the clamping device 30 may further comprise a plurality of slide rails 351 and slide blocks 353 that are connected to and movable along the slide rails 351. Specifically, the slide block 353 is connected to the clamping part 311 and/or the connecting band 37, and the slide block 353 and the clamping part 311 are movable with the connecting band 37. The slide rail 351 is not connected to the connecting band 37 directly, and will not move with the connecting band 37. The rotation of the servomotor 331 drives the clamping part 311 and the slide block 353 via the connecting band 37 moving along the slide rail 351 to adjust the position of the clamping part 311.

The structure of the first clamping device 21 and the second clamping device 23 described in FIG. 2 and FIG. 3 may be similar to the clamping device 30 of FIG. 4. Further, the structure of the clamping device 30 described in the embodiment of the invention is not limitation of the invention, and the first clamping device 21 and the second clamping device 23 may achieve the same function with different structure.

FIG. 5 to FIG. 8 are section views of using steps of the cutting mechanism according to an embodiment of the invention. Please referring to FIG. 2, the feeding unit 27 feeds the roll fiber product 221 to the first clamping device 21 and the second clamping device 23. When the roll fiber product 221 is pushed to preset position by the feeding unit 27, the first clamping device 21 and the second clamping device 23 are actuated to clamp the roll fiber product 221 to fix the position of the roll fiber product 221, as shown in FIG. 4.

Figure 5:
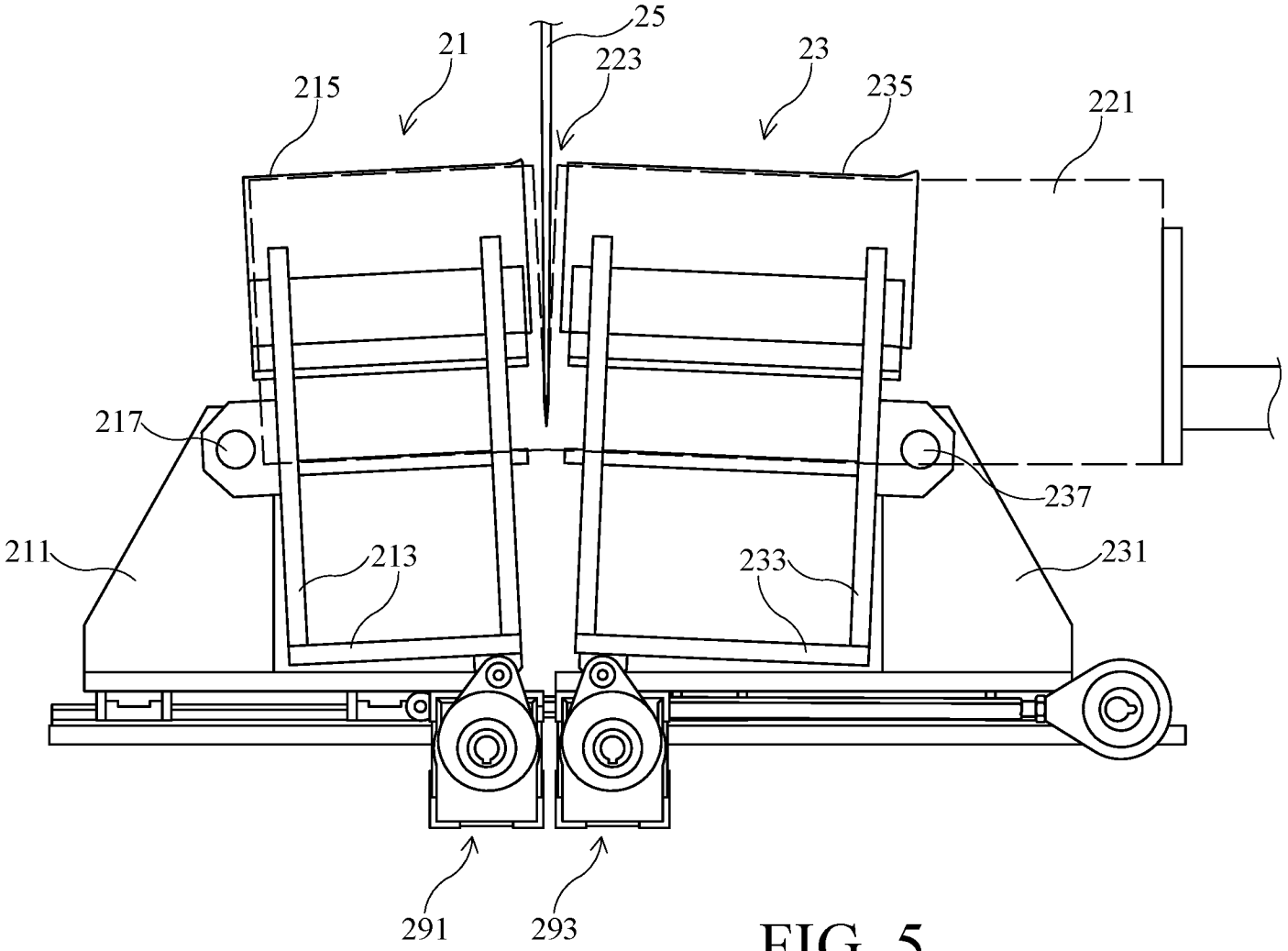
FIG. 5 to FIG. 8 are section views of using steps of the cutting mechanism according to an embodiment of the invention.

The blade 25 is actuated to move toward the gap 223 to cut the roll fiber product 221 that is clamped by the first clamping device 21 and the second clamping device 23. When the blade 25 cuts or contacts the roll fiber product 221, the first push unit 291 and the second push unit 293 will be actuated to respectively drive the first connecting unit 213 and the second connecting unit 233 swinging relative to the first seat 211 and the second seat 231. For example, the first push unit 291 drives the first connecting unit 213 counterclockwise rotating on the first shaft 217, and the second push unit 293 drives the second connecting unit 233 clockwise rotating on the second shaft 237. Thus, the first clamping unit 215 and the second clamping unit 235 break the roll fiber product 221 therebetween, as shown in FIG. 5.

Specifically, when the blade 25 cuts the roll fiber product 221, the side surface or the edge of the blade 25 will contact the roll fiber product 221 causing increase of the friction between the blade 25 and the roll fiber product 221. Thus, the wear rate of the blade 25 may be increase, and uneven of the cut surface of the cut roll fiber product 221 may be formed.

In this invention, the contact area and the friction between the blade 25 and the roll fiber product 221 can be reduced, since the first clamping unit 215 and the second clamping unit 235 break the roll fiber product 221 therebetween during cutting process. Thus, the flatness of the cutting surface of the roll fiber product 221 can be improved, and the wear rate of the blade 25 can be reduced.

Figure 6:
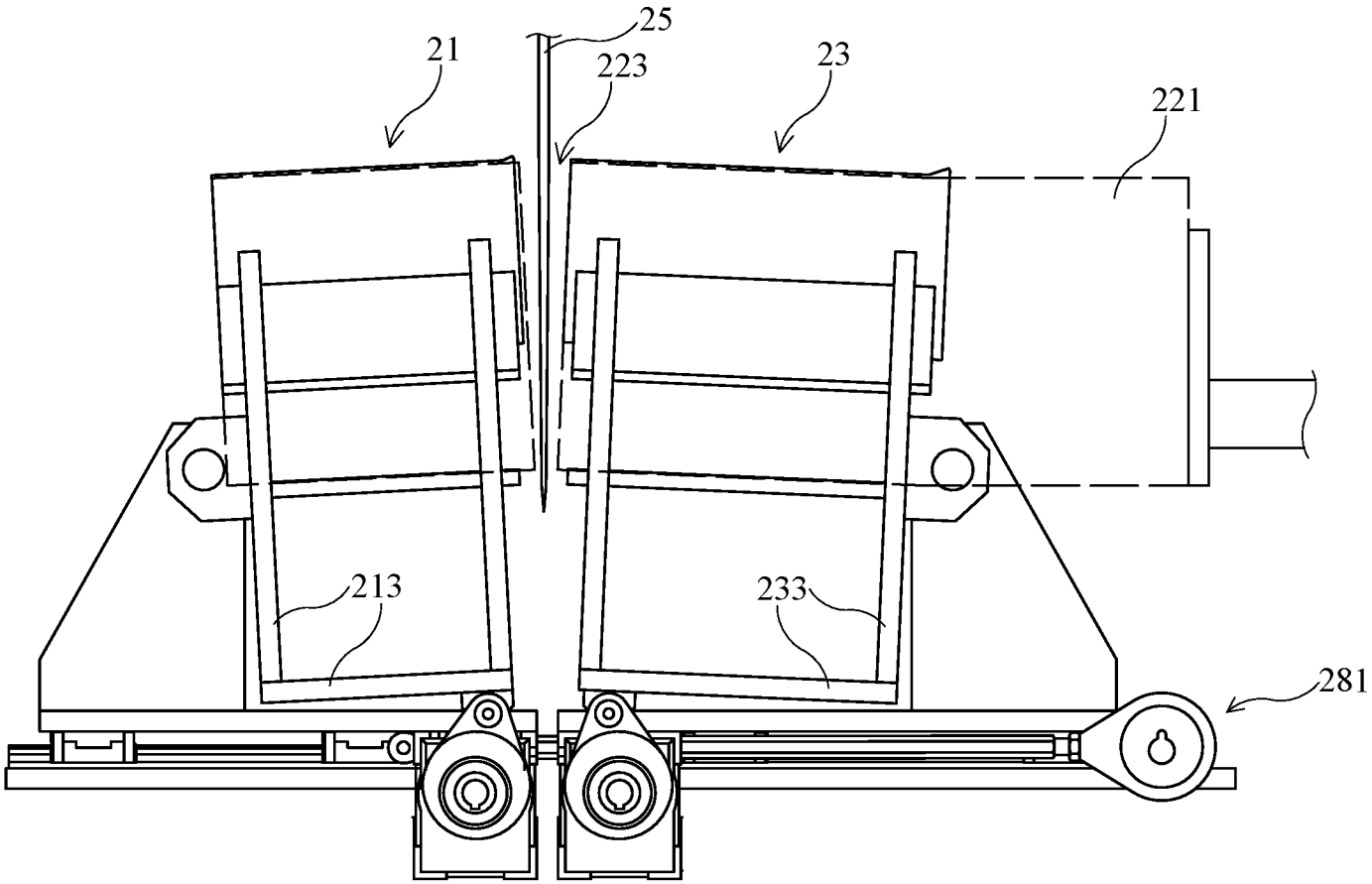

Furthermore, as the blade 25 cuts the roll fiber product 221, the push-pull devices 28 drive the first clamping device 21 and the second clamping device 23 moving to opposite direction to increase the size of the gap 223 therebetween. Thus, the contact area and the friction between the blade 25 and the roll fiber product 221 can be further reduced, as shown in FIG. 6.

Figure 7:
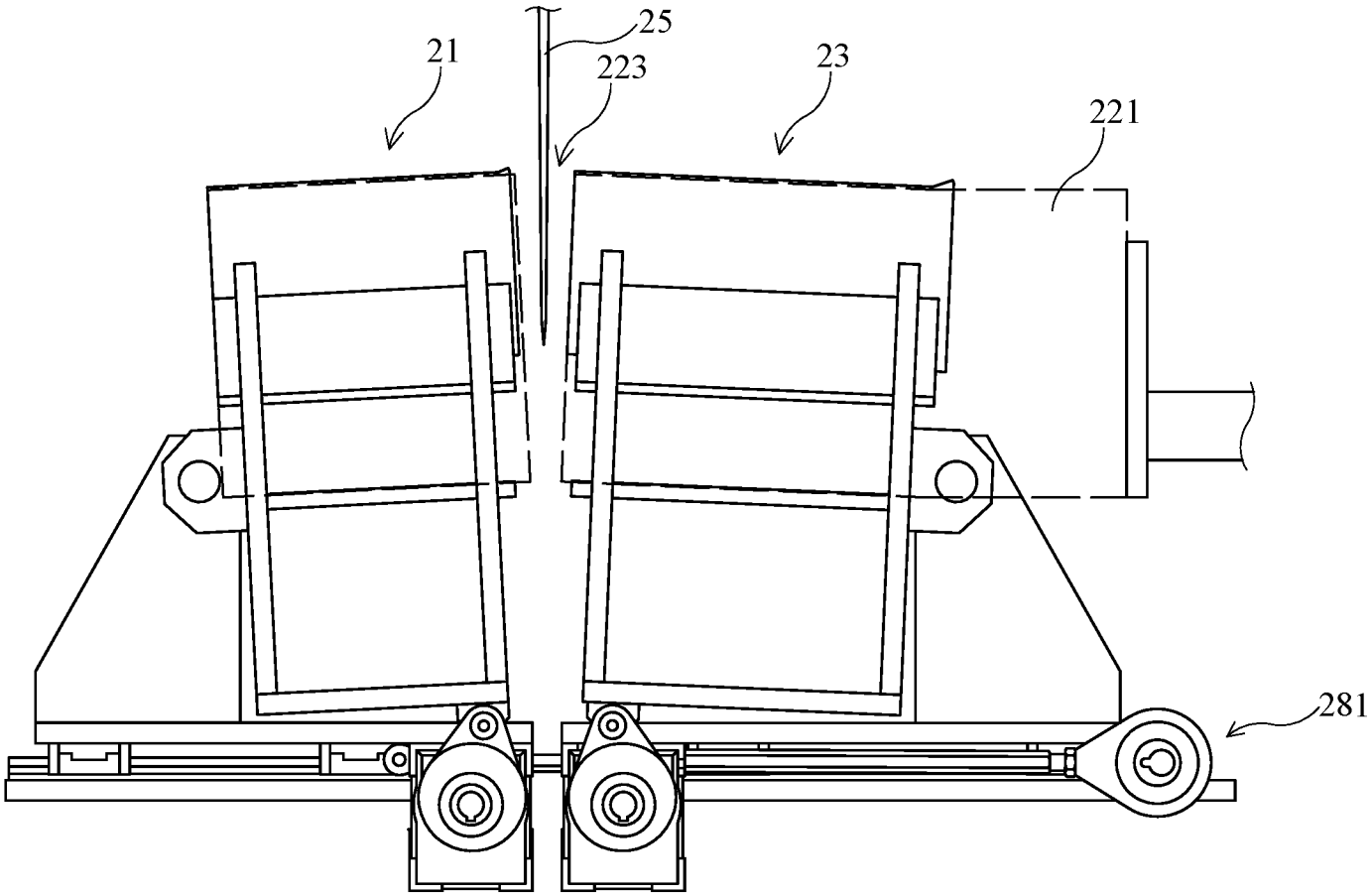

After the blade 25 completes the cutting of the roll fiber product 221, the push-pull devices 28 drive the first clamping device 21 and the second clamping device 23 to further increase the size of the gap 223 therebetween to avoid the blade 25 touching the cut roll fiber products 221 during it return to original position, as shown in FIG. 7. Thus, damage of the cutting surface of the cut roll fiber product 221 can be prevented.

Figure 8:
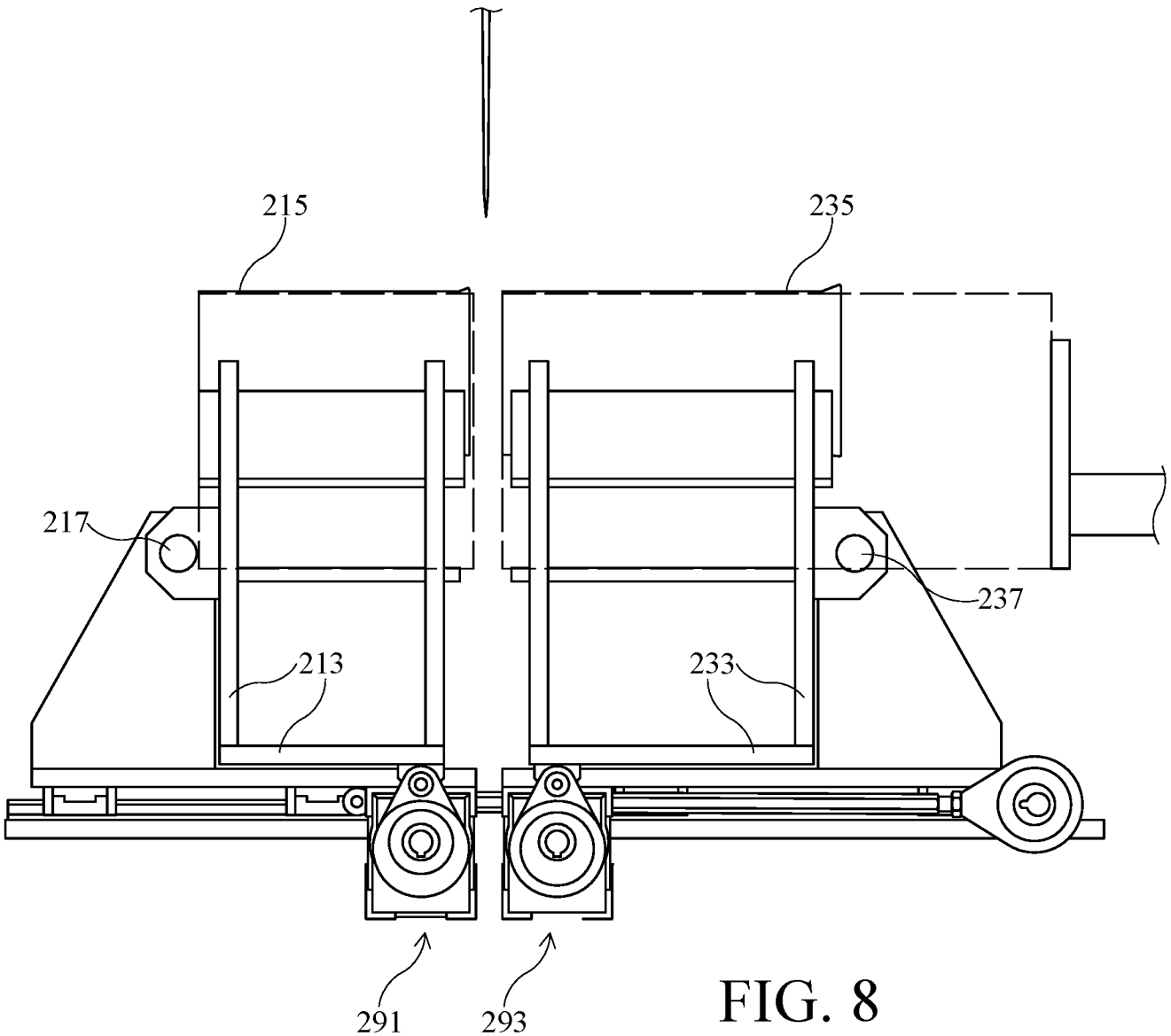

When the blade 25 leaves the roll fiber product 221, the first push unit 291 and the second push unit 293 will drive or pull the first connecting unit 213 and the second connecting unit 233 swinging on the first shaft 217 and the second shaft 237 respectively, and the first connecting unit 213, the first clamping unit 215, the second clamping unit 235 and the second connecting unit 233 swing back to original angle or position, as shown in FIG. 8. For example, the first connecting unit 213 and the first clamping unit 215 rotate in the clockwise direction, and the second connecting unit 233 and the second clamping unit 235 rotate in the counterclockwise direction.

Thereafter, the push-pull devices 28 drive the first clamping device 21 and the second clamping device 23 closing each other, and thus the roll fiber product 221 on the first clamping device 21 touches the roll fiber product 221 on the second clamping device 23. The first clamping device 21 and the second clamping device 23 loose the roll fiber product 221. Then the feeding unit 27 pushes the roll fiber product 221 from the second clamping device 23 to the first clamping device 21, and the cut roll fiber product 221 on the first clamping device 21 is pushed to leave the first clamping device 21. When the roll fiber product 221 is pushed to the preset position of the first clamping device 21 and the second clamping device 23 by the feeding unit 27, the first clamping device 21 and the second clamping device 23 will clamp the roll fiber product 221 for cutting, as shown in FIG. 2.

Through the cycle of the steps described above in FIG. 2 and FIG. 5 to FIG. 8, the roll fiber product 221 will be cut to desired size.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

What is claimed is:

1. A cutting mechanism for roll fiber products, comprising:

a first clamping device, comprising:

a first seat;

a first connecting unit connected to said first seat via a first shaft;

a first clamping unit connected to said first connecting unit for clamping a roll fiber product;

a second clamping device adjacent to said first clamping device, and a gap being formed between said first clamping device and said second clamping device, said second clamping device comprising:

a second seat;

a second connecting unit connected to said second seat via a second shaft;

a second clamping unit connected to said second connecting unit for clamping said roll fiber product;

a blade for cutting said roll fiber product located on said gap;

a feeding unit for feeding said roll fiber product from said second clamping device to said first clamping device;

a push-pull device comprising a first push-pull unit and a second push-pull unit respectively connected to said first seat and said second seat, wherein said first push-pull unit and said second push-pull unit respectively drive a displacement of said first clamping device and said second clamping device to adjust a size of said gap between said first clamping device and said second clamping device; and a push device comprising a first push unit and a second push unit respectively connected to said first connecting unit and said second connecting unit, and respectively driving said first connecting unit and said second connecting unit to swing on said first shaft and said second shaft relative to said first seat and said second seat.

2. The cutting mechanism of claim 1, wherein said first clamping unit and said second clamping unit both comprise at least one supporting part for supporting said roll fiber product, and at least one clamping part for clamping said roll fiber product.

3. The cutting mechanism of claim 2, wherein said first clamping device and said second clamping device comprising:

a plurality of wheels;

a servomotor; and a connecting band connecting to said clamping parts of said first clamping unit and said second clamping unit, and installed on said wheels and said servomotor, wherein rotation of said servomotor drives said clamping parts via said connecting band to clamp said roll fiber product.

4. The cutting mechanism of claim 3, comprising a cylinder connected to said servomotor or said connecting band via a swing arm to fix a position of said clamping parts via the connecting band, or drive displacement of said clamping parts via said connecting band.

5. The cutting mechanism of claim 4, wherein said first clamping device and said second clamping device both comprise a plurality of slide rails and a plurality of slide blocks, wherein each of said slide blocks is connected to said clamping parts and located on said slide rails respectively, and rotation of said servomotor drives said clamping parts and said slide blocks moving along said slide rails via said connecting band to clamp said roll fiber product.

6. The cutting mechanism of claim 1, wherein said first push-pull unit and said second push-pull unit both comprise at least one cam and at least one connecting rod, and said cams of said first push-pull unit and said second push-pull unit are respectively connected to said first seat and said second seat via said connecting rods.

7. The cutting mechanism of claim 6, wherein said cams of said first push-pull unit and said second push-pull unit are located on a rod, and rotation of said rod drives said cams of said first clamping device and said second clamping device rotating or swinging to adjust said size of said gap between said first clamping device and said second clamping device.

8. The cutting mechanism of claim 1, wherein said first seat of said first clamping device and said second seat of said second clamping device are respectively connected to at least one slide block located on a slide rail, and said first push-pull unit and said second push-pull unit are respectively connected to said first seat and said second seat via said slide blocks to drive said first seat and said second seat moving along said slide rail.

9. The cutting mechanism of claim 1, wherein said first push unit and said second push unit both comprise at least one cam, and said cams of said first push unit and said second push unit respectively drive said first connecting unit and said second connecting unit swinging relative to said first seat and said second seat.

10. The cutting mechanism of claim 9, wherein said cams of said first push unit and said second push unit are respectively connected to a rod that is connected to said first seat and said second seat via a reducer.

* * * * *